US006666178B1

(12) United States Patent
Keller et al.

(10) Patent No.: US 6,666,178 B1
(45) Date of Patent: Dec. 23, 2003

(54) VALVE DEACTIVATION WITH AN ELECTRO-HYDRAULIC ACTUATOR

(75) Inventors: Robert D. Keller, Davisburg, MI (US); Michael L. Rasnick, Attica, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/214,843

(22) Filed: Aug. 8, 2002

(51) Int. Cl.[7] ..... F01L 9/02

(52) U.S. Cl. ..... 123/90.12; 123/90.16; 123/90.13; 123/90.11; 251/102; 251/129.19

(58) Field of Search ..... 123/90.11, 90.12, 123/90.13, 90.16, 90.22, 90.23, 90.33, 198 F; 251/78, 95, 98, 102–104, 107, 129.15, 129.19

(56) References Cited

U.S. PATENT DOCUMENTS 4,576,128 A * 3/1986 Kenichi ..... 123/90.16
5,619,958 A * 4/1997 Hampton et al. ..... 123/90.16
6,092,497 A * 7/2000 Preston et al. ..... 123/90.16
6,481,409 B1 * 11/2002 Wade et al. ..... 123/198 F

* cited by examiner

*Primary Examiner*—Thomas Denion
*Assistant Examiner*—Kyle Riddle
(74) *Attorney, Agent, or Firm*—Roger A. Johnston

(57) ABSTRACT

An electro-hydraulic actuator assembly having a plurality of hydraulic pressure operated pistons controlled by a single solenoid operated shut-off and vent valve. Eaton hydraulic piston has an exteriorly extending arm attached thereto for contacting a release latch on the engine valve gear for disablement or deactivation of the valves in selected engine combustion chambers. The actuator assembly is disposed with the shut-off and vent valve vent port vertically above the hydraulic piston bores; and, a bleed orifice is provided for bleed flow from the hydraulic piston bores to the valving chamber in the shut-off and vent valve for permitting bleed flow and air purge. Gravity flow from the vent port may also provide lubrication for the engine cam surface.

26 Claims, 7 Drawing Sheets

VALVE DEACTIVATION WITH AN ELECTRO-HYDRAULIC ACTUATOR

BACKGROUND OF THE INVENTION

The present invention relates to electrically operated hydraulic actuators which, in response to an electrical control signal cause an electrically operated valve device to control the flow of pressurized hydraulic fluid to a pressure responsive actuator for performing a desired function. Electro-hydraulic actuators are found in widespread usage with a solenoid operated valve employed as the electrically responsive control device for pressurizing piston or diaphragm type pressure responsive actuators.

Recent demands for increased fuel economy and reduced emissions from internal combustion engines, particularly for motor vehicle applications, have resulted in the development of systems for selectively deactivating the combustion chamber valves in multi-cylinder engines during operation in order to disable combustion in certain of the combustion chambers. This arrangement has been found to be desirable where relatively large displacement multi-cylinder engines are employed in vehicles requiring substantial engine power during portions of the operating cycle but substantially less power in other portions of the cycle. For example, during the idling portion of the operating cycle it is not required that combustion occur in all cylinders of the engine to maintain engine operation. However, when acceleration or power to maintain speed on a grade is required, it is then desired to engage all combustion chambers for firing.

Heretofore, systems for selectively deactivating combustion chamber valves during engine operations have provided for releasable latch mechanisms in the valve gear train of cam operated combustion chamber valves. Such latches, upon release, permit lost motion of the valve gear components which prevents valve movement or "lift" of the combustion chamber poppet valves from their closed position against the valve seats. Early forms of engine valve deactivators employed an electric actuator such as a solenoid for moving a latch holding the pivot fulcrum of each valve; and, thus one electrical actuator was required for each valve to be deactivated. This arrangement proved to be not only relatively costly for high volume motor vehicle engine production but also consumed a prohibitive amount of space or volume and often required enlarged valve gear covers of the engine which created problems in packaging the original in the vehicle engine compartment. Therefore, it was desired to provide a way or means of reducing the number of electrical actuators required for effecting deactivation of selected combustion chamber valves. Furthermore, the amount of electrical power required to operate the number of solenoids required to deactivate the desired number of valves, as for example, up to half of the number of combustion chamber valves in the engine, placed a prohibitive burden upon the engine electrical power source which is typically relatively low voltage in the range of 12 to 14 volts direct current.

Thus, it has been desired to provide a way or means of reducing the number of solenoids and the size of the solenoids required for selective combustion chamber valve deactivation and yet provide the speed of actuation for movement of the valve deactivating latch mechanism during the cam dwell or base circle period at the engine speed.

It has been proposed to use electro-hydraulic actuators for engine valve deactivation. However, such an arrangement employs a solenoid operated valve for each hydraulic actuator for each valve. This letter arrangement would reduce the power requirements for each solenoid but does not reduce the number of solenoids for each engine valve to be deactivated and thus does not enable engine valve deactivators to be utilized without sufficiently increasing the volume of the engine.

BRIEF SUMMARY OF THE INVENTION

Broadly, the present invention provides an electro-hydraulic actuator of the type employing a solenoid operated valve for controlling flow of pressurized hydraulic fluid to a pressure responsive actuator. More particularly, the electro-hydraulic actuator of the present invention includes a block having a plurality of bores with moveable pistons therein connected to a common valving chamber to which pressurized hydraulic fluid is valved by a single solenoid operated valve. Each of the pistons is connected respectively externally of its bore to an actuator member adapted for operatively contacting a deactivating member for an engine combustion chamber valve. The electro-hydraulic actuator of the present invention includes a bleed passage above the bores for bleeding air from the system upon the depressurization of the piston bores. The electro-hydraulic actuator of the present invention thus enables a single solenoid operated valve to deactivate a hydraulically powers a plurality of actuators for deactivating a plurality of combustion chamber valve mechanisms.

DETAILED DESCRIPTION OF THE INVENTION

Figure 1:
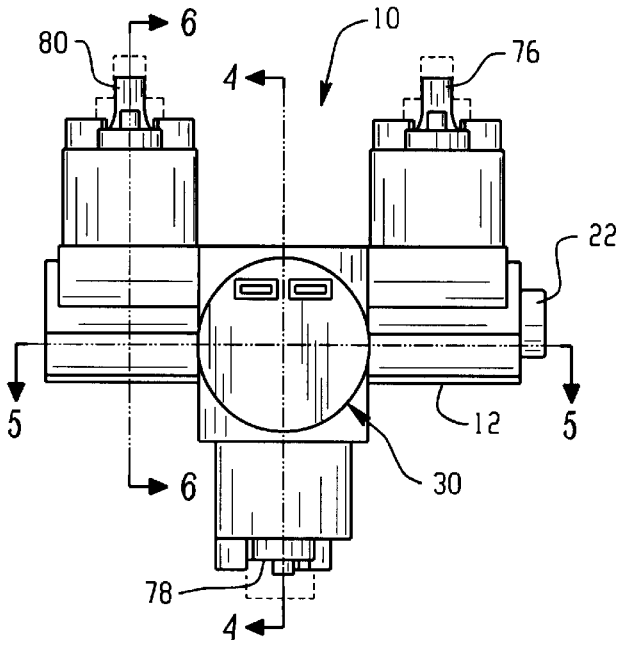
FIG. 1 is a top view of the electro-hydraulic actuator of the present invention.
Figure 3:
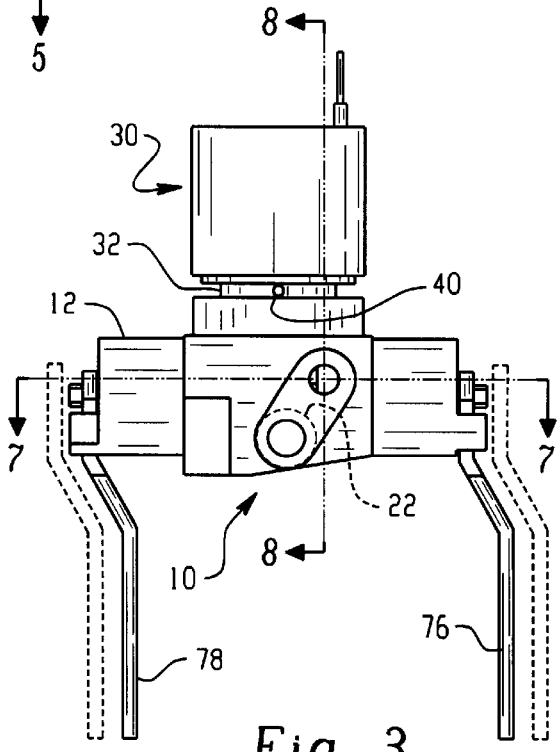
FIG. 3 is a right side view of the assembly of FIG. 1.

Referring to FIGS. 1 through 8, the electro-hydraulic actuator of the present invention is indicated generally at 10 and includes a body 12 having therein a valving chamber 14 which communicates with a valve seat 16 formed about inlet passage 18 which communicates with supply channel 20 which extends through the block 12 and is adapted to have one end thereof plugged as indicated at 22, with the other end thereof connected to a source (not shown) of pressurized fluid as, for example, engine lubricant from the oil pump circuit pressure galleries.

In the presently preferred practice of the invention, the valve seat 16 is formed on an annular valve seat member 24 which is inserted in a bore 26 formed in the valving chamber and which communicates with inlet passage 20. The valve seat member 24 is sealed in the bore 26 by any suitable expedient, as for example, a resilient seal ring 28.

A solenoid operator indicated generally at 30 has a valving body 32 formed with a valving outlet passage 34 therein which terminates in an annular valve seat 36 formed at the end of the outlet passage 34. Valving body 32 is sealed in valving chamber 14 by any suitable expedient, as for example, resilient seal ring 38. Outlet passage 34 communicates with exhaust ports 40 formed in body 32 for exhausting fluid from the valving chamber 14.

A moveable valve member or obturator 42 is disposed in the valving chamber 14 between the inlet valve seat 16 and the outlet valve seat 36 for movement therebetween. Solenoid operator 30 includes an operating rod member 43 indicated in dashed outline in FIGS. 4 and 5 which member is operable upon energization of solenoid operator 30 to effect movement of the valve from inlet valve seat 16 to admit fluid from passage 20 through passage 18 into the valving chamber 14. Upon de-energization of the solenoid operator 30, operating rod member 43 moves valve member 42 to the closed position against valve seat 16 and opens valve seat 36 to permit fluid to exhaust through passage 34 and ports 40.

A fluid pressure manifold passage 44 is formed in the valve body 12 in spaced parallel arrangement with the inlet passage 20. Manifold passage 44 communicates with a plurality of piston bores 46, 48, 50 (see FIG. 7) each of which has disposed therein a piston denoted respectively 52, 54, 56 and slidably sealed therein by a seal ring denoted respectively 58, 60, 62. Each of the pistons 52, 54, 56 has extending therefrom a piston rod denoted respectively 64, 66, 68 which extend outwardly of the respective piston bores; and, the outwardly extending end of each piston rod is slidably guided by a suitable bearing denoted respectively 70, 72, 74 received in the end of each of the piston bores.

Figure 2:
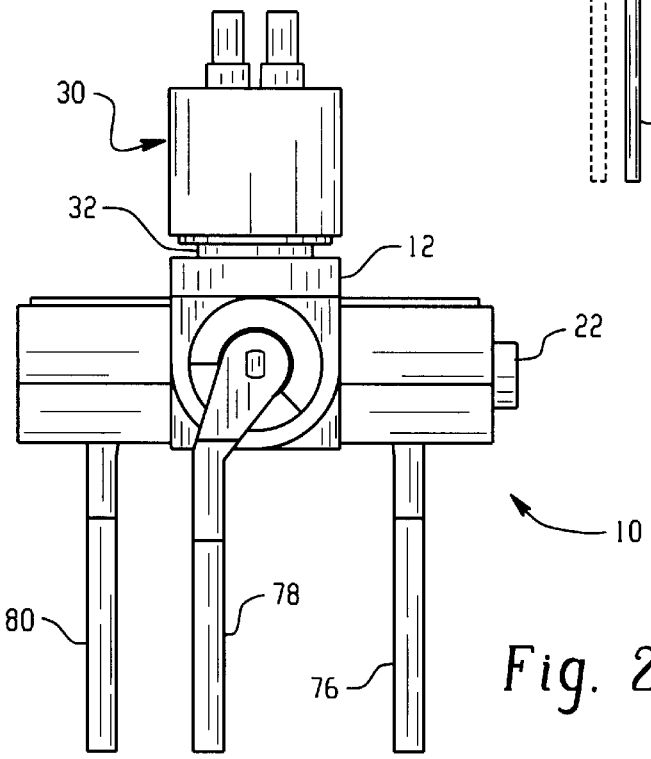
FIG. 2 is a front elevation view of the assembly of FIG. 1.
Figure 4:
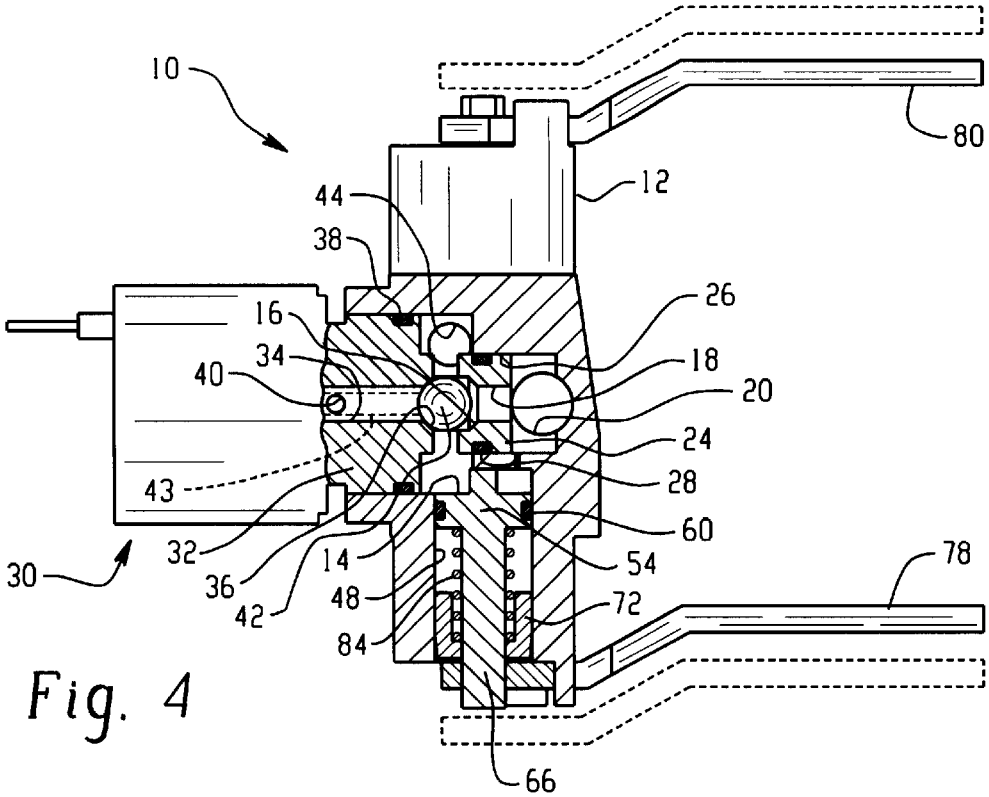
FIG. 4 is a section view taken along section indicating lines 4—4 of FIG. 1.

Each of the piston rods has connected to the end thereof extending from the piston bore an actuating member in the form of an arm denoted respectively 76, 78, 80 which arm extends from the body 12. In the present practice of the invention the arms 76, 78, 80 are arranged in spaced parallel arrangement as shown in FIG. 2 for implementation with an overhead cam type engine valve gear; however, it will be understood that other arrangements may be used.

Each of the piston rods 64, 66, 68 has disposed thereabout a spring denoted respectively 82, 84, 86 which bias the pistons respectively inwardly of the piston bores 46, 48, 50.

In the presently preferred practice of the invention, manifold passage 44 is formed by drilling in the end of the body 12 to a depth intersecting piston bore 50; and, the open end of manifold passage 44 is sealed with a plug such as the spherical member 88 precision pressed into the open end of the passage 44. However, alternatively body 12 may be cast with manifold passage 44, piston bores 46, 48, 50, inlet passage 18 and valving chamber 14 cored therein.

In the presently preferred practice of the invention, piston bores 46, 50 are aligned in spaced parallel arrangement extending in a common direction; and, piston bore 48 is disposed therebetween and extending parallel with respect thereto in an opposite direction. It will be understood however that the number and arrangement of the piston bores may be varied to accommodate different engine valve and valve gear arrangements.

Figure 6:
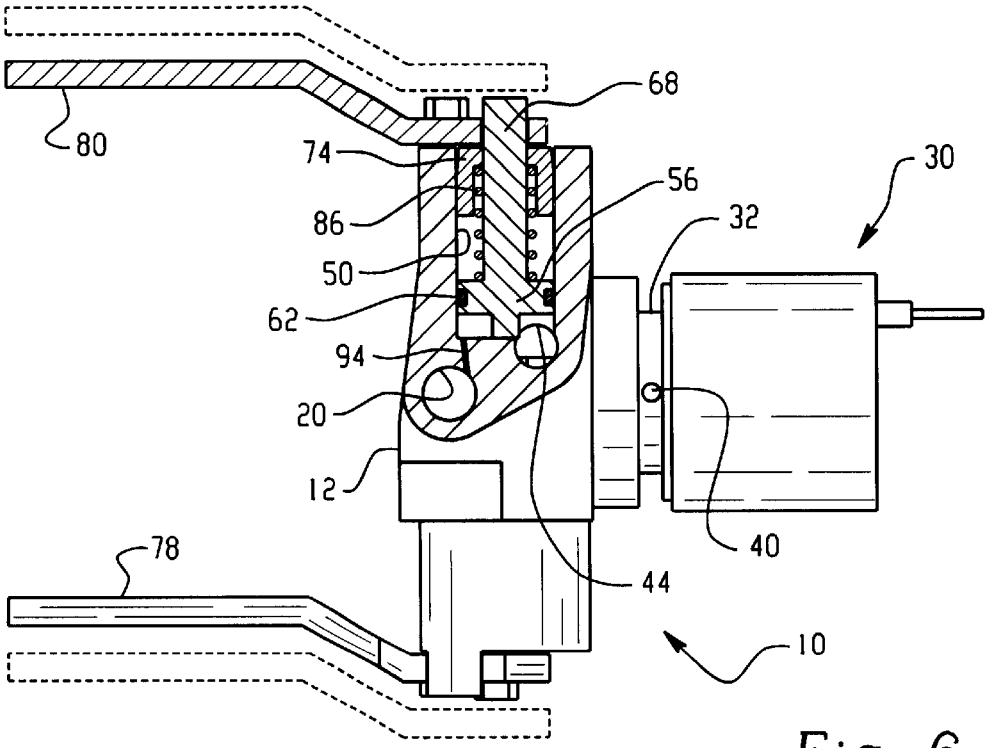
FIG. 6 is a section view taken along section indicating lines 6—6 of FIG. 1.
Figure 8:
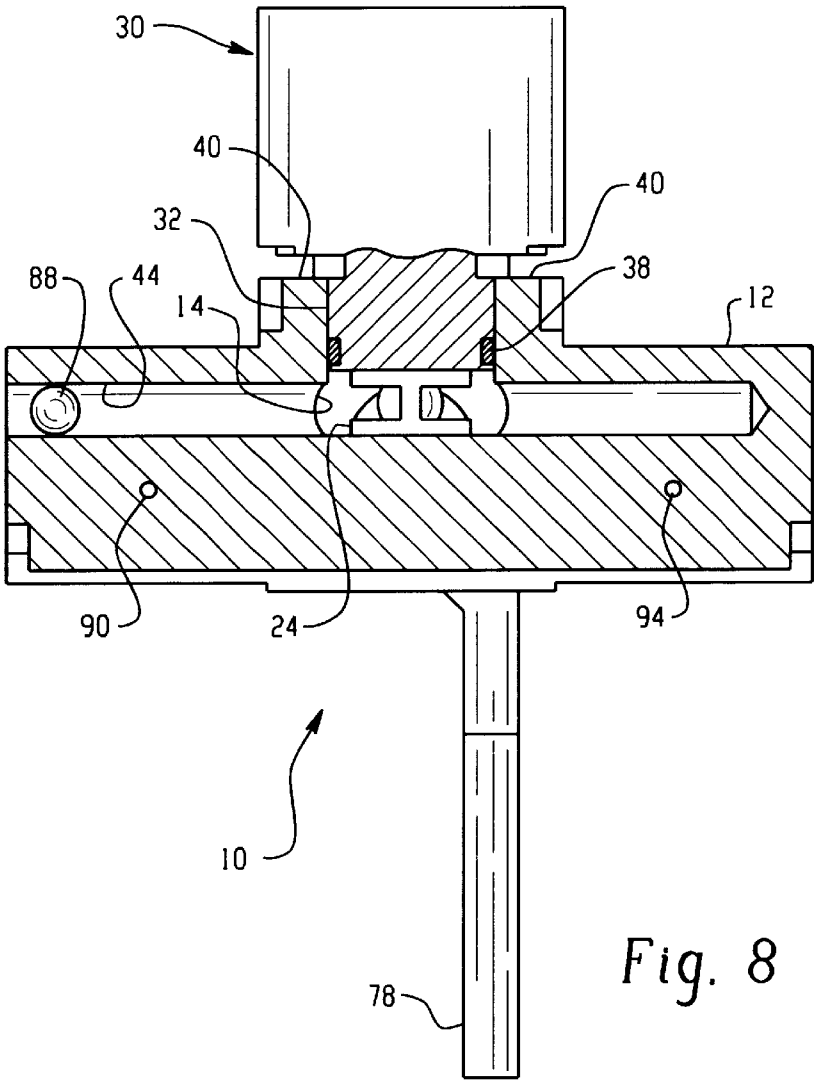
FIG. 8 is a section view taken along section indicating lines 8—8 of FIG. 3.
Figure 5:
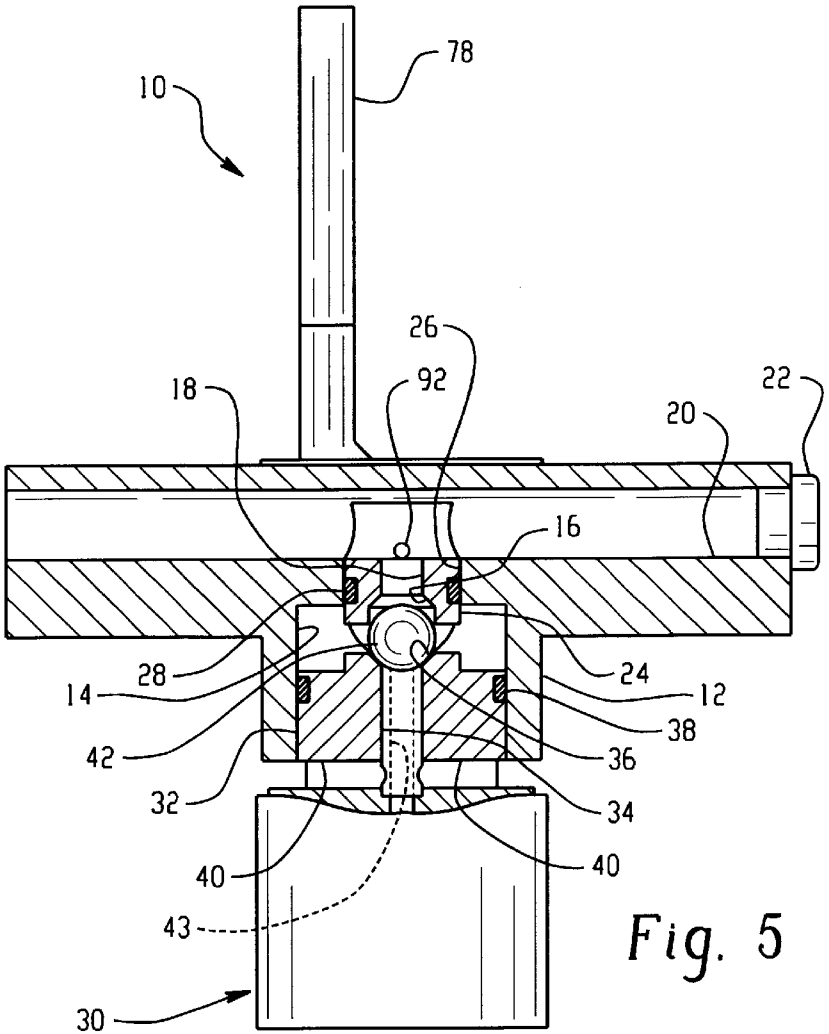
FIG. 5 is a section view taken along section indicating lines 5—5 of FIG. 1.
Figure 7:
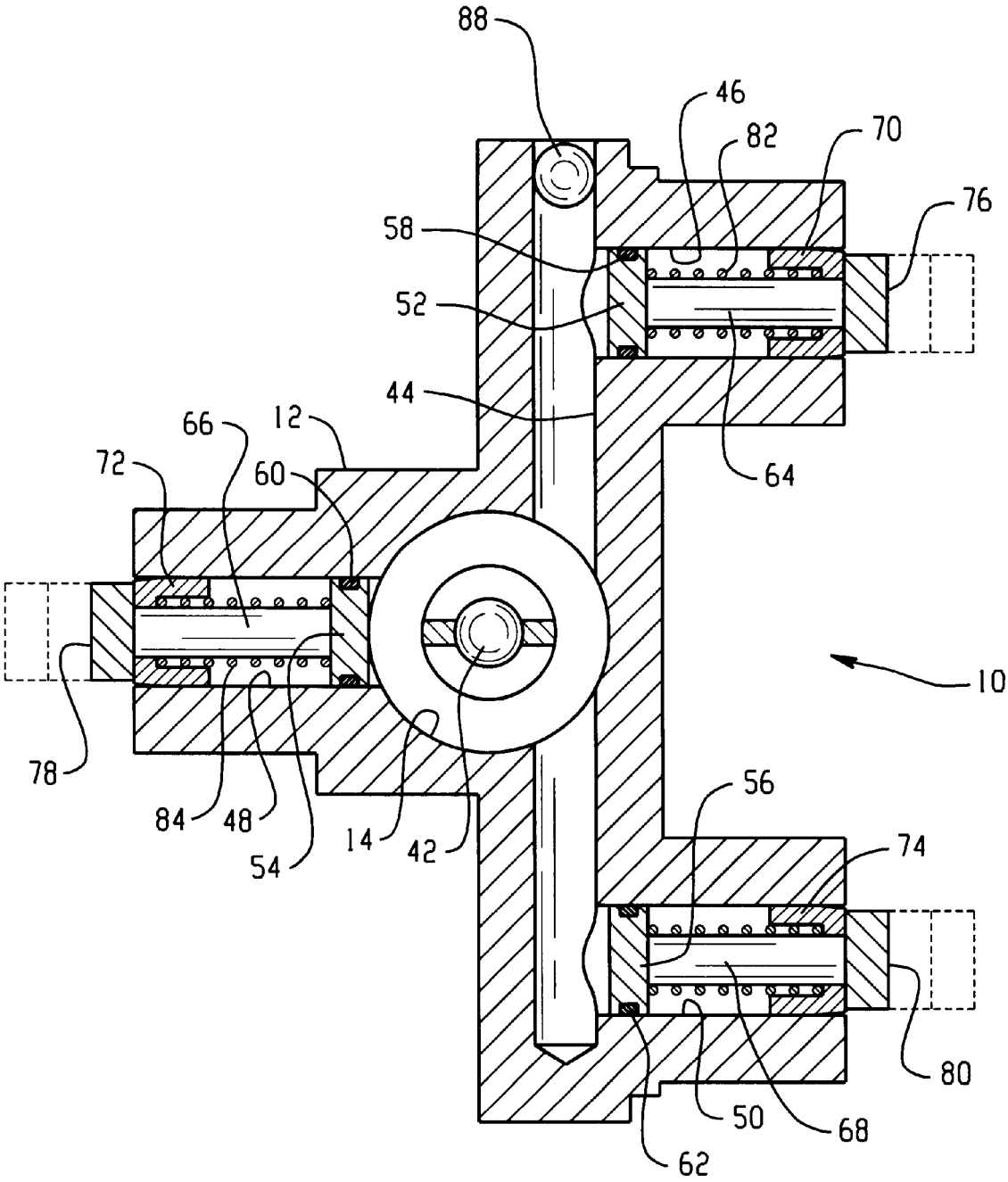
FIG. 7 is a section view taken along section indicating lines 7—7 of FIG. 3.
Figure 9:
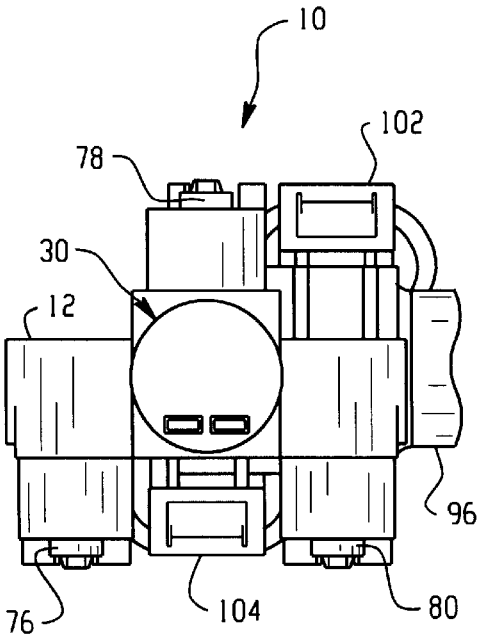
FIG. 9 is a top view of a portion of the combustion chamber valve gear for an engine showing the invention installed for deactivating the engine valves.
Figure 10:
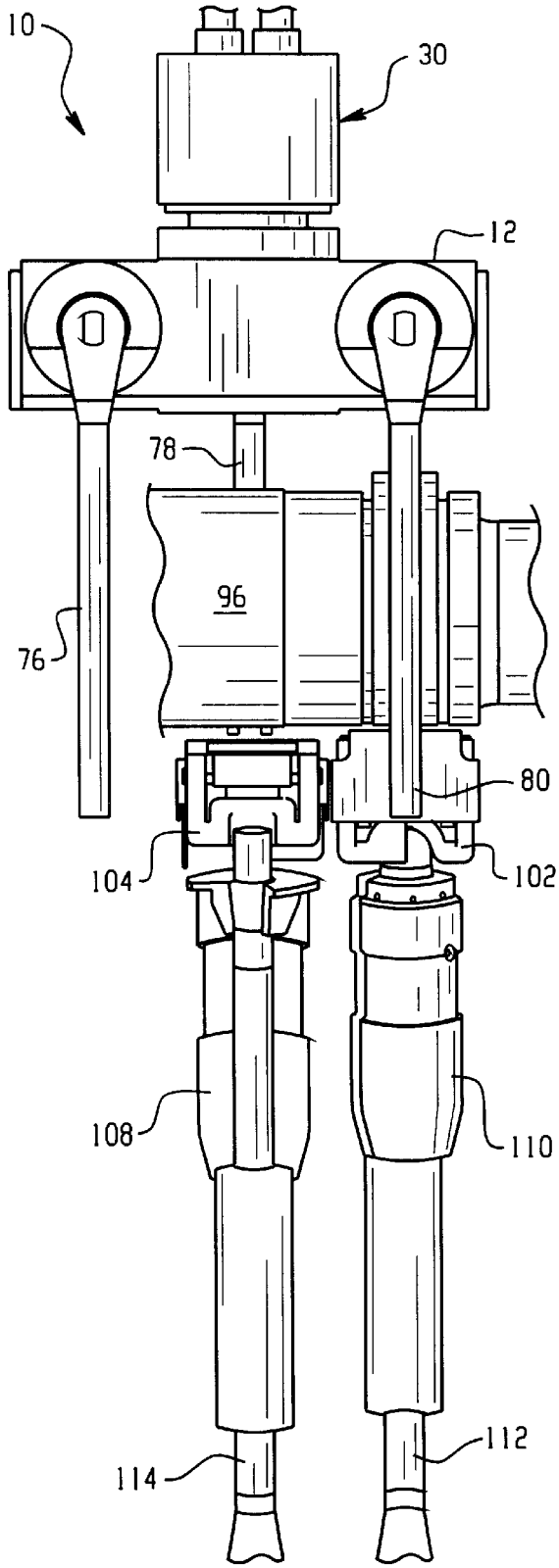
FIG. 10 is a front elevation view of the installation of FIG. 9.

Referring to FIGS. 5, 6 and 8, a bleed passage is provided in each piston bore respectively as denoted by reference numerals 90, 92, 94 which connect the piston bore with the inlet passage 20. The bleed passages 90, 92, 94 thus permit a small amount of bleed flow to the piston bores 46, 48, 50 when valve 42 is closed against seat 16. It will be understood that when inlet seal 16 is closed, outlet seat 36 and passage 34 and exhaust ports 40 are open. Solenoid operated valve 30 thus functions as a shut-off and vent valve with respect to valving chamber 14. Advantageously, bleed flow to the ports 40 is effective to purge trapped air when the assembly 10 is installed in the valve gear arrangement and orientated as shown in FIG. 9 with ports 40 disposed vertically above the piston bores 46, 48, 50. In addition, the location of the exhaust or vent port 40 vertically above the engine cam serves to provide a gravity flow of lubricant for lubricating the cam surface.

In operation, it will be understood that upon energization of the solenoid 30 valve 42 is raised from seat 16 and pressurized fluid from the inlet passage 20 flows into the valving passage 14 through the manifold passage 44 and into the piston bores forcing the pistons in an outward direction to move the actuator arms to the position shown in dashed outline in the drawings. This movement of the actuator arms 76, 78, 80 is employed for valve deactivation in a manner as will hereinafter be described.

Referring now to FIGS. 9 through 12, the electro-hydraulic actuator 10 is shown installed in the valve gear of an overhead cam engine having an overhead camshaft 96 with roller followers 98,100 each mounted on a rocker arm 102, 104 respectively which have an end thereof respectively pivoted on a stationary lash adjuster 108,110 with the opposite end thereof pivotally contacting the end of an intake valve 112 and an exhaust valve 114 respectively. Each of the rocker arms 102,104 includes a moveable latch member, one of which is illustrated in the foreground and shown in FIG. 11 and denoted reference numeral 106 for the exhaust valve rocker arm 104.

Actuator 10 is mounted on suitable engine structure (not shown) to maintain its position and orientation with respect to the engine valve gear. It will be understood that rocker arm 102 effects actuation of intake valve 112 and rocker arm 104 effects actuation of exhaust valve 114 during normal engine operation and rotation of the camshaft 96.

Figure 11:
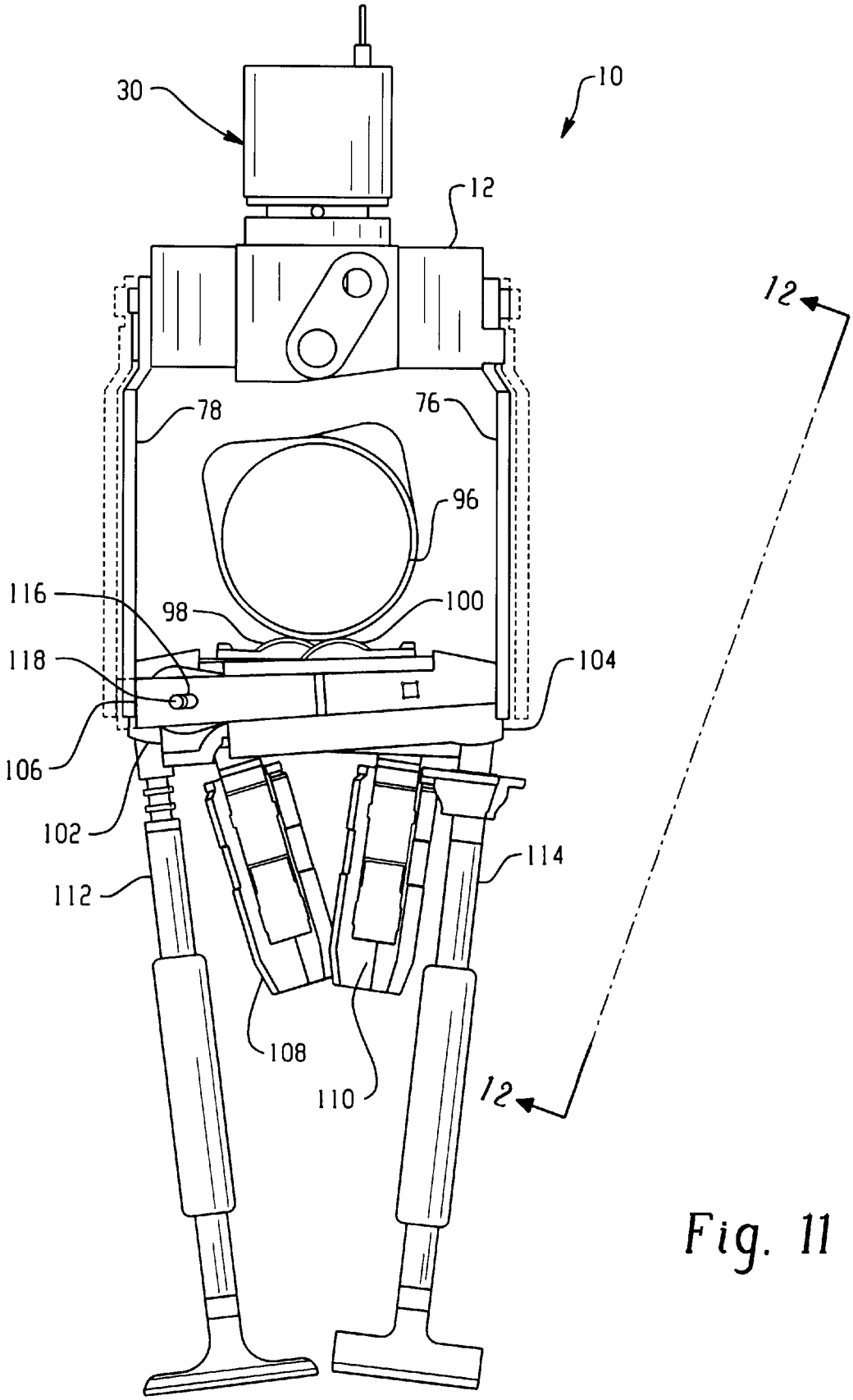
FIG. 11 is a side elevation view of the installation of FIG. 9.
Figure 12:
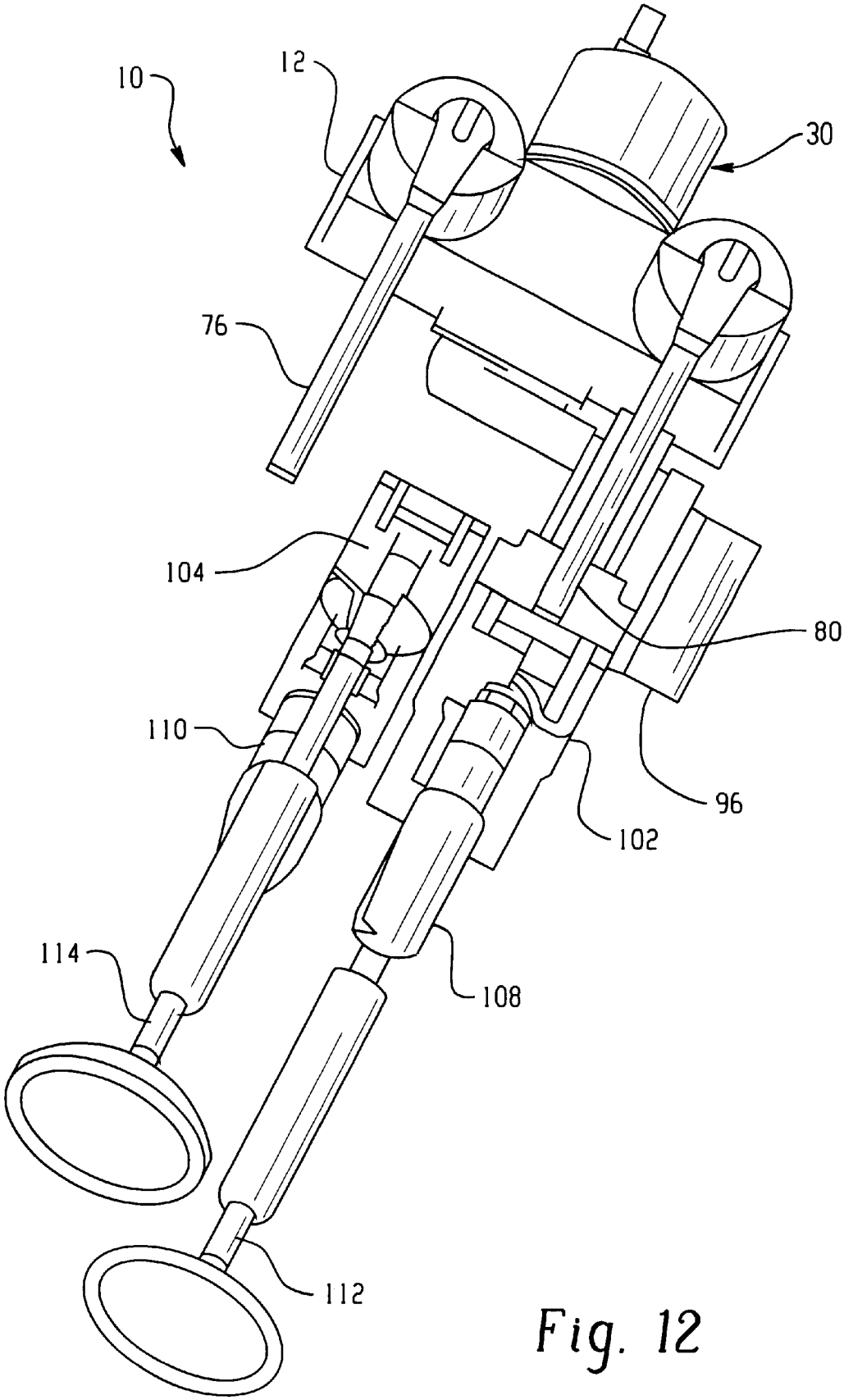
FIG. 12 is a view taken along view indicating lines 12—12 in FIG. 11.

For normal engine operation, actuator arm 78 of the actuator 10 contacts the end of rocker arm latch member 106 to hold it in the position shown in FIG. 11 with the end of the slot 116 registered against the pin 118 to engage the latch and effect normal movement of the exhaust valve 114. Upon energization of the solenoid operator 30, actuator 10 causes arm 78 to move to the position shown in dashed outline thereby permitting latch member 106 to move to the position shown in dashed outline with the opposite end of slot 116 contacting the opposite side of pin 118 and effecting release of the latch mechanism in the rocker arm 104 which causes the rocker arm to provide lost motion and disablement of the movement of the valve 114. In a similar fashion, actuator arm 80, which contacts the end of a latch (not shown) but similar to member 106 on rocker arm 102, is moved to the position shown in dashed outline in FIG. 11 for disablement of movement of the intake valve 112. It will be understood that actuator arm 76 contacts a third rocker arm latch mechanism (not shown) for disablement of a third combustion chamber valve (not shown). It will be understood that the valve gear arrangement illustrated is for an arrangement wherein the engine has two intake valves and one exhaust valve; and, the second intake valve has been omitted for simplicity of illustration.

The present invention thus provides a simple and low cost electro-hydraulic actuator for use in engine valve disablement wherein a single solenoid operated hydraulic actuator can disable plural valves. The arrangement of the present invention thus provides an electro-hydraulic actuator requiring minimum volume for installation in the engine and reduced power consumption for the solenoid operators.

Although the invention has hereinabove been described with respect to the illustrated embodiments, it will be understood that the invention is capable of modification and variation and is limited only by the following claims.

What is claimed is:

1. An electro-hydraulic operator for use in engine valve de-actuation comprising:

(a) a valve body having a valving cavity therein with an inlet port having a first valving surface associated therewith and a vent port having a second valving surface associated therewith and the inlet port adapted for connection to a source of pressurized hydraulic fluid;

(b) at least one piston bore communicating with said valving cavity;

(c) a piston slidably disposed in said piston bore and moveable in response to fluid pressure therein;

(d) an actuation member extending externally of said body and attached to said piston for movement therewith;

(e) an obturator disposed in said cavity and moveable for opening and closing with respect to said first valving surface and said second valving surface for permitting and preventing flow between said inlet port and said valving cavity and between said cavity and said vent port;

(f) a solenoid disposed with said body and having an armature operatively connected for, upon energization and de-energization, effecting said movement of said obturator, wherein said actuator member is adapted for operative contact with a valve de-actuation component of the engine; and, (g) a bleed passage in said body communicating said at least one piston bore with said vent port, said bleed passage operative to permit limited flow for air purging from said inlet port through said at least one bore to said vent port when said obturator is closed against said first valving surface and is open with respect to said second valving surface.

2. The operator defined in claim 1, wherein said at least one piston bore includes a plurality of piston bores.

3. The operator defined in claim 1, wherein said obturator comprises a generally spherical member.

4. The operator defined in claim 1, wherein said at least one piston bore includes a plurality of piston bores disposed in spaced arrangement.

5. The operator defined in claim 1, wherein said valve body includes a bleed passage communicating said at least one piston bore to said vent port.

6. The operator defined in claim 1, wherein said vent port is located to discharge a gravity flow of fluid for engine component lubrication.

7. The operator defined in claim 1, wherein said at least one piston bore includes means biasing the piston in a direction to oppose movement caused by hydraulic pressure therein.

8. The operator defined in claim 1, wherein said vent port is disposed vertically at a higher level than said at least one piston bore.

9. The operator defined in claim 1, wherein two of said piston bores are disposed in opposing directions.

10. The operator defined in claim 1, wherein said obturator has a generally ball-shaped configuration.

11. An electro-hydraulic operator for use in engine valve de-actuation comprising:

(a) a valve body having a valving cavity therein with an inlet port having a valving surface associated therewith and a vent port having a valving surface associated therewith, the inlet port adapted for connection to a source of pressurized hydraulic fluid;

(b) a plurality of piston bores each communicating with said valving cavity;

(c) a piston slidably disposed in each of said piston bores and moveable in response to fluid pressure therein;

(d) an actuator member extending externally of said body and attached to said piston for movement therewith;

(e) an obturator disposed in said cavity and moveable for opening and closing with respect to said inlet port valving surface and said vent port valving surface for permitting and preventing flow between said inlet port and said valving cavity and between said cavity and said vent port;

(f) a solenoid disposed with said body and having an armature operatively connected for, upon energization and de-energization, effecting said movement of said obturator, wherein said actuator member is adapted for operative contact with a valve de-actuation component of the engine, wherein said vent port is located vertically at a level higher than said plurality of piston bores for facilitating air bleed when the vent port is opened.

12. The operator defined in claim 11, wherein each of said piston bores includes a bleed passage communicating with said inlet port when said obturator is closed against said inlet valving surface.

13. The operator defined in claim 11, wherein each of said piston bores includes a bleed passage communicating with said inlet port.

14. The operator defined in claim 11, wherein each of said piston bores includes means biasing said piston in a direction to oppose the pressure forces of hydraulic fluid acting thereon.

15. The operator defined in claim 11, further comprising means biasing the obturator closed on said inlet valving surface.

16. A method of making an electro-hydraulic operator for use in engine valve de-actuation comprising:

(a) forming a valve body having a valving cavity with an inlet port having a valving surface associated therewith and a vent port having a valving surface associated therewith;

(b) forming a plurality of piston bores in said body and communicating each of said bores with said cavity;

(c) disposing a piston in each of said bores for movement in response to fluid pressure therein;

(d) connecting an actuator member to each of said pistons and extending said member externally of said bore for contacting an engine valve de-actuation component;

(e) disposing an obturator in said cavity for movement between positions alternately opening and closing said inlet port valving surface and said vent port valving surface;

(f) disposing a solenoid with said body and operatively connecting the solenoid armature for, upon energization and de-energization effecting said obturator movement; and, (g) forming a bleed passage in said body associated with each of said bores and communicating said bleed passage with said valving chamber.

17. The method defined in claim 16, wherein the step of forming a body includes locating the vent port vertically at a higher level than said piston bores.

18. The method defined in claim 16, wherein the step of disposing an obturator includes disposing a spherical member intermediate said inlet port valving surface and said outlet port valving surface.

19. The method defined in claim 16, wherein said step of forming a plurality of piston bores includes forming a plurality of bores disposed in spaced parallel arrangement.

20. The method defined in claim 16, wherein said step of disposing a piston in each of said bores includes biasing the piston in a direction to oppose the hydraulic fluid pressure forces acting thereon.

21. The method defined in claim 16, wherein said step of connecting an actuator member to each of said pistons includes attaching an end of an actuator arm to an end of the piston.

22. The method defined in claim 16, wherein said step of forming a plurality of piston bores includes forming at least two bores extending in opposing directions.

23. The method defined in claim 16, wherein said step of forming a plurality of piston bores includes forming three bores with the axes thereof lying in a common plane.

24. The method defined in claim 16, wherein said step of connecting a solenoid armature for effecting movement of the obturator includes biasing the armature in a direction moving said obturator closed on said inlet valving surface.

25. A method of de-actuating cam operated combustion chamber valves during engine operation comprising:

(a) disposing a lost motion release having a moveable latch in the engine valve train between the cam and each of the valves for a combustion chamber;

(b) disposing a single solenoid operated shut-off and vent valve controlled hydraulic actuator vertically above said latchable release and disposing an actuating member from the actuator for contact with each latch;

(c) locating the vent outlet of said solenoid operated valve vertically above the cam and discharging a gravity flow of fluid for lubricating the cam surface; and, (d) connecting said solenoid operated valve to a source of pressurized hydraulic fluid and energizing the solenoid valve and effecting movement of the latch for causing said lost motion in the valve train and de-actuating the valves.

26. The method defined in claim 25, wherein said step of connecting said valve to a source of pressurized fluid includes connecting the valve to the engine lubricant pump gallery.

* * * * *